US006309034B1

(12) United States Patent
Credle, Jr. et al.

(10) Patent No.: US 6,309,034 B1
(45) Date of Patent: Oct. 30, 2001

(54) OSCILLATING COOLER

(75) Inventors: William S. Credle, Jr., Stone Mountain; James R. Bardin, Atlanta, both of GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/439,830

(22) Filed: Nov. 12, 1999

(51) Int. Cl.[7] ..... A47F 3/11

(52) U.S. Cl. ..... 312/116; 312/266; 312/305; 312/135; 62/256; 108/94

(58) Field of Search ..... 62/254, 256, 255, 62/336, 275; 312/116, 125, 135, 139, 266, 270, 304, 305, 319.5, 319.7, 408, 410; 108/94, 21

(56) References Cited

U.S. PATENT DOCUMENTS

| | | | | |
|---|---|---|---|---|
| 555,550 | * | 3/1896 | Yost | 312/135 X |
| 1,857,545 | | 5/1932 | Hill . | |
| 1,872,032 | | 8/1932 | Frick et al. . | |
| 2,261,910 | | 11/1941 | Wright . | |
| 2,610,473 | | 9/1952 | Chovanec . | |
| 2,677,940 | | 5/1954 | Raskin . | |
| 2,928,705 | | 3/1960 | Goldsmith . | |
| 2,950,605 | | 8/1960 | Hennion . | |
| 3,021,691 | | 2/1962 | Jacobs . | |
| 3,063,255 | | 11/1962 | Fanick, Jr., et al. . | |
| 3,769,805 | | 11/1973 | Corini . | |
| 4,185,810 | | 1/1980 | Eichenberger et al. . | |
| 4,261,183 | | 4/1981 | Plomp . | |
| 4,299,099 | | 11/1981 | Myers et al. . | |
| 5,097,673 | | 3/1992 | Negishi . | |
| 5,125,240 | | 6/1992 | Knippscheer et al. . | |
| 5,458,407 | * | 10/1995 | Bustos et al. | 312/135 X |
| 5,549,373 | * | 10/1996 | Bustos | 312/135 |
| 5,567,026 | * | 10/1996 | Lacewell | 312/116 X |
| 5,664,435 | | 9/1997 | Bassuk . | |
| 5,689,967 | | 11/1997 | Floysvik . | |
| 5,797,279 | | 8/1998 | Osborne . | |

FOREIGN PATENT DOCUMENTS

| | | |
|---|---|---|
| 1 948 650 | 4/1971 | (DE) . |
| 0 761 141 | 3/1997 | (EP) . |
| 0 903 549 | 3/1999 | (EP) . |

* cited by examiner

*Primary Examiner*—Peter M. Cuomo
*Assistant Examiner*—Michael J. Fisher
(74) *Attorney, Agent, or Firm*—Sutherland Asbill & Brennan LLP

(57) ABSTRACT

A cooler with a number of product shelves and an oscillating drive mechanism. The oscillating drive mechanism is connected to the product shelves so as to rotate the product shelves in an oscillating manner.

27 Claims, 5 Drawing Sheets

OSCILLATING COOLER

TECHNICAL FIELD

The present invention relates generally to coolers and refrigerators and more particularly relates to coolers with oscillating product shelves.

BACKGROUND OF THE INVENTION

Various types of coolers and refrigerators are commonly used to present different types of products for sale. The coolers generally have a transparent door, a lid, or another type of entrance such that a consumer can see the products therein. The products are generally placed on shelves within the cooler. As is well known, the consumer opens the door to the cooler and grasps the desired product or products. Such coolers are commonly used to sell refrigerated products such as bottles or cans of beverages. These beverages may include coffee; tea; water; fruit, vegetable, and juice concentrates; fruit, vegetable, and juice beverages; isotonic beverages; non-isotonic beverages; milk and milk by-products; carbonated soft drinks; and soft drink concentrate. The products also may include one or more food brands or other types of consumable items.

Various approaches have been used in the past to make an individual cooler, or the products within that cooler, stand out from the surrounding environment. One goal of cooler design is to have the cooler, or the products within the cooler, catch the consumer's eye. Such an attraction may lead to an increase in product sales. These approaches have included, for example, various types of advertising promoting the products, different lighting effects within or around the cooler, the use of sound, and various combinations of attractions so as to grab the consumer's attention.

Another method by which to attract the consumer's attention is to create motion within the cooler. For example, commonly owned U.S. patent application Ser. No. 09/110,847, entitled "Rotary Cooler", describes a cooler with a number of product shelves that may rotate three hundred and sixty degrees (360°). Each shelf has an exposed portion with a number of products placed thereon, an interior portion for storage of products, and a panel separating the two areas. Products are moved between the exposed portion and the interior portion via an internal pusher device. When a sensor indicates that a product has been removed from the exposed area, the pusher device pushes another one of the product from the interior portion to the exterior portion. The disclosure of U.S. patent application Ser. No. 09/110,847 is incorporated herein by reference.

Although the rotary cooler as described therein has proved to be effective in catching the eye of the consumer through the use of motion, the cooler has several drawbacks. For example, the cooler has numerous moving parts that must be maintained. The cooler is therefore expensive to construct and expensive to operate as compared to conventional coolers. Loading the cooler also has turned out to be somewhat difficult in that the products should be located within the interior portion of the cooler. The interior portion of the cooler, however, is not directly accessible such that the cooler may not always be loaded in a first in and a first out basis. Further, because this cooler does not use a door, consumers may not believe the products are sufficiently cold.

What is needed, therefore, is a cooler that uses motion to attract the eye of the consumer. The motion within the cooler must be accomplished in a safe and cost effective manner. Further, the cooler should be relatively inexpensive to construct, operate, maintain, and reload as compared to most types of conventional coolers.

SUMMARY OF THE INVENTION

The present invention thus provides a cooler with a number of product shelves and an oscillating drive mechanism. The oscillating drive mechanism is connected to the product shelves so as to rotate the product shelves in an oscillating manner. The cooler thus provides internal motion so as to catch the consumer's eye. The cooler also provides for easy reloading in a first in and first out manner.

Specific embodiments of the present invention include the cooler having an outer door with a transparent panel such that the product shelves may be seen. The outer door includes a door switch in communication with the oscillating drive mechanism. The door switch turns the oscillating drive mechanism off when the outer door is opened. A consumer may then remove a product from the product shelf while the shelf is not moving. The cooler may include an outer shell and a door with a substantially circular shape or any other conventional shape.

The product shelves may be made out of stainless steel, aluminum, or thermoplastics. The product shelves may have a substantially circular shape. The product shelves may have a rotation speed of about one-eighth (0.125) to about two (2) feet per second. One or more shelves may rotate first in a first direction while one or more other shelves may rotate first in a second direction. The product shelves may oscillate from a central point by about five degrees (5°) to about thirty degrees (30°). The product shelves may include a number of product channels positioned thereon. Each of the product shelves may have a first product channel positioned on a first side of the product shelf and a second product channel positioned on a second side of the product shelf. The product shelves may oscillate in a first direction such that the first product channel is accessible and then oscillate in a second direction such that the second product channel is accessible. The product shelves may have an angled shape with a first end and a second end. The second end may extend about seven degrees (7°) to about nine degrees (9°) beyond the first end. The product shelves also may be gravity feed organizers.

The oscillating drive mechanism may include one or more drive shafts powered by an electrical motor so as to rotate the shelves. The shelves may be supported for rotation within the cooler by a series of rollers. The drive shafts may rotate the shelves via a set of drive gears. The oscillating drive mechanism may have a first drive shaft and a second drive shaft with the first drive shaft powered by the electrical motor. The drive shafts may be connected by a set of rotation gears such that the first drive shaft rotates in a first direction and the second drive rotates in a second direction. One of the shelves may be connected to the first drive shaft and another one of the shelves may be connected to the second drive shaft.

The cooler also may include a reload switch in communication with the oscillating drive mechanism. The reload switch causes the oscillating drive mechanism to rotate the product shelves about one hundred eighty degrees. The product shelves each may have an upper end and a lower end such that the products slide towards the lower end of the shelves. The reload switch causes the product shelves to rotate such that the upper end of the shelf faces the user. The user may then reload the shelves via the upper end such that the products slide from the upper end to the lower end. The user again hits the reload switch such that the product shelves are rotated until the lower end of the shelves faces the door.

The cooler also may include a door control system. The door control system may include an outer door and a drive motor. The door control system also may have a sensor to detect the presence of a consumer such that the sensor activates the drive motor to open the door when the consumer is present. The sensor also activates the drive motor to close the door when the consumer is no longer present.

The method of the present invention provides for reloading a cooler with a number of products. The cooler may have a door and a number of product shelves. The product shelves may have a first end facing the door and a second end facing away from the door. The method may include the steps of opening the door, rotating the product shelves such that the second end faces the door, loading products onto the product shelves via the second end, and rotating the product shelves such that the first end again faces the door.

A further embodiment of the present invention provides for an improved cooler. The cooler may have an outer shell with an aperture therein and a door positioned adjacent to the aperture. The cooler also may have a door control system. The door control system may have a drive motor and a sensor such that the sensor causes the drive motor to operate the door when the sensor is triggered. The outer door may have a curved shape. The door may be positioned within the cooler. The sensor activates the drive motor to open the door when a consumer is present and also activates the drive motor to close the door when a consumer is no longer present. The sensor may be a touch sensor, a light detector, a thermal detector, a sound detector, or other conventional types of detection devices. The door control system also may include control means so as to delay the opening or closing of the door as desired.

Other objects, features, and advantages of the present invention will become apparent upon review of the following detailed description of the preferred embodiments of the present invention when taken in conjunction with the drawings and the appended claims.

DETAILED DESCRIPTION OF THE INVENTION

Figure 1:
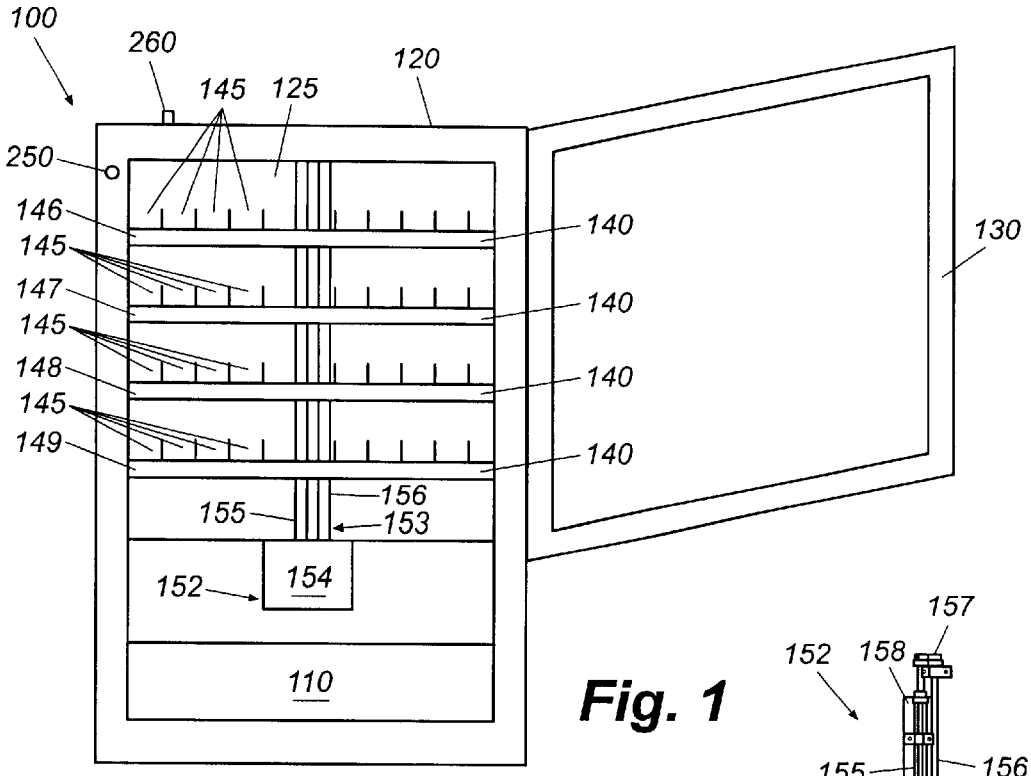
FIG. 1 is a perspective view of a cooler of the present invention.
Figure 2:
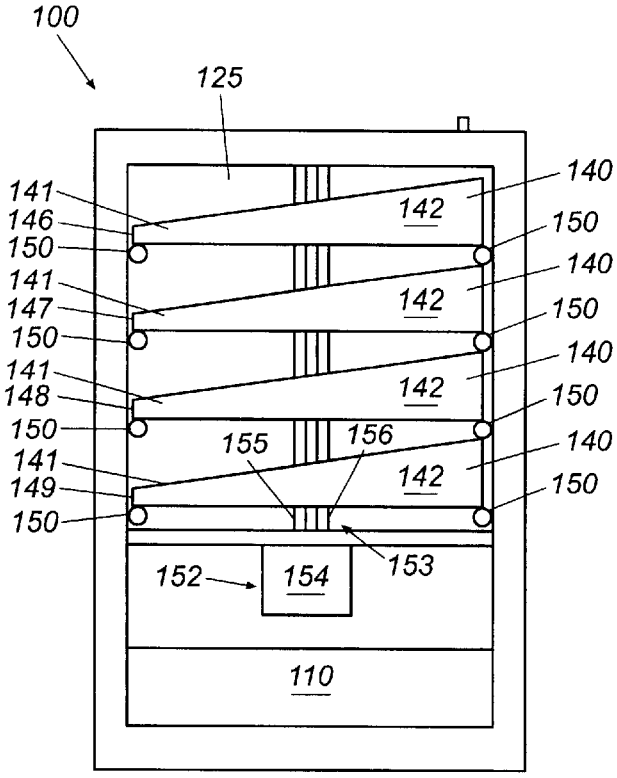
FIG. 2 is a side cross sectional view of a cooler of the present invention.
Figure 3A:
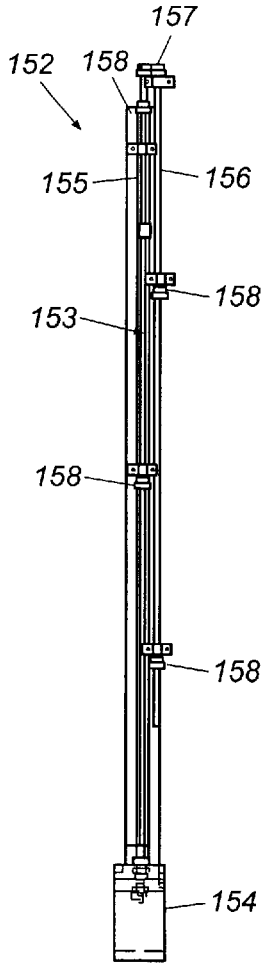
FIG. 3A is plan view of the drive mechanism.
Figure 4A:
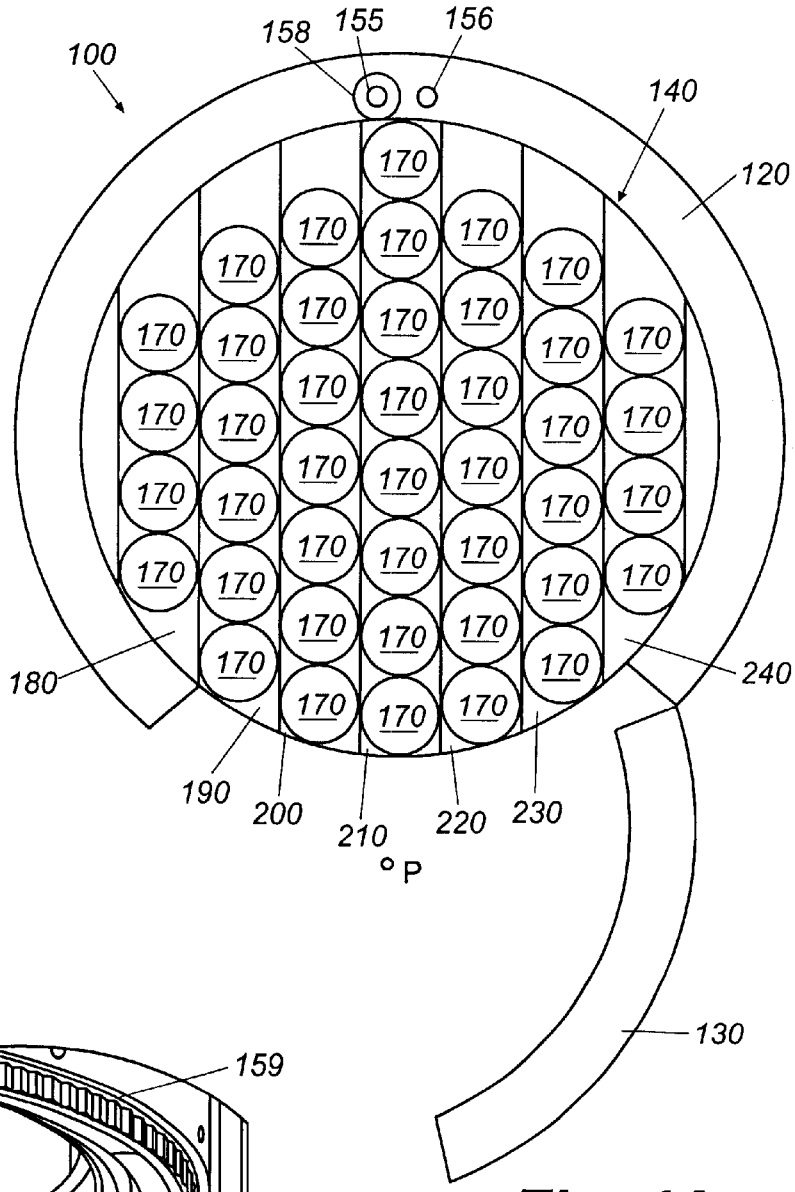
FIG. 4A is a plan view of a shelf of the present invention with a plurality of products placed within the product channels.
Figure 3B:
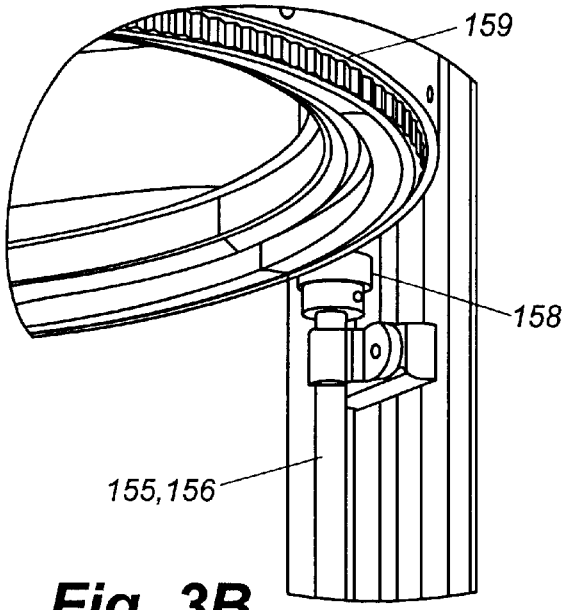
FIG. 3B is a perspective view of the shelf and the drive mechanism.
Figure 4B:
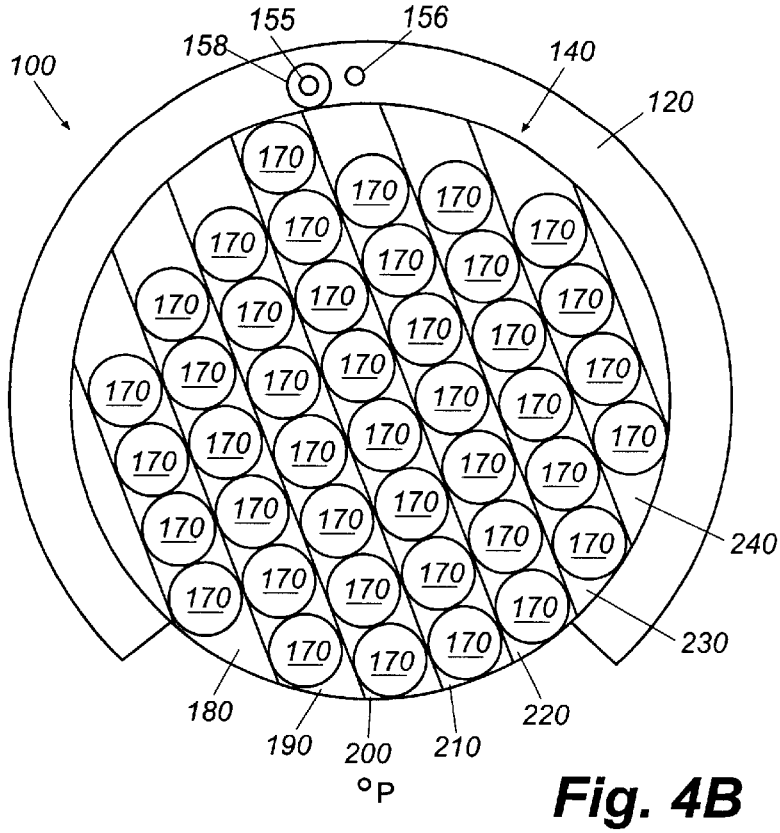
FIG. 4B is a plan view of the shelf rotated in a counter-clockwise fashion
Figure 4C:
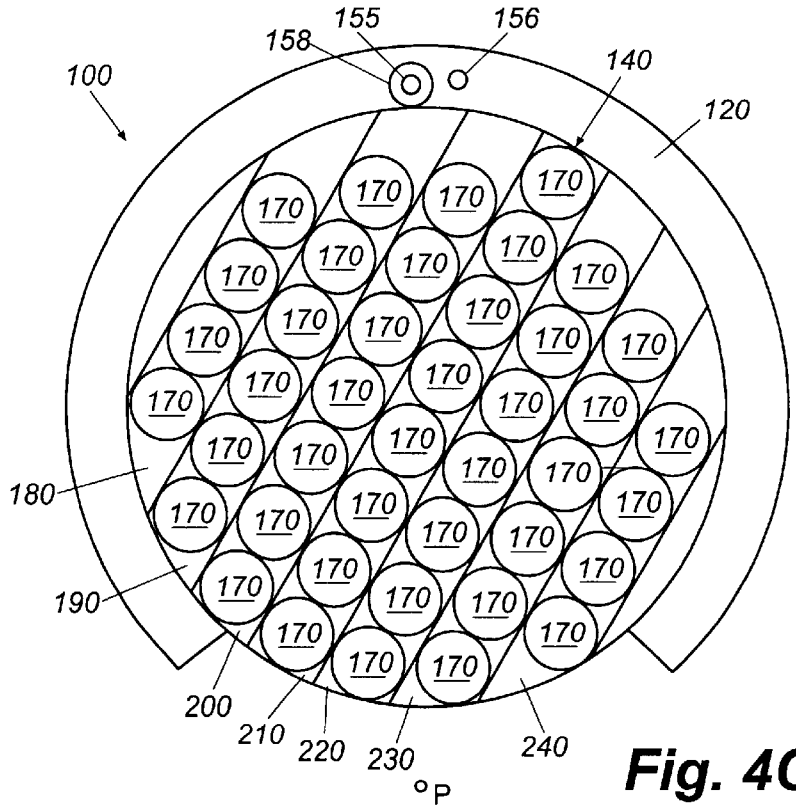
FIG. 4C is a plan view of the shelf rotated in a clockwise fashion.

Referring now in more detail to the drawings, in which like numerals refer to like parts throughout the several views, FIGS. 1, 2, 3A, and 3B show a cooler 100 of the present invention. The cooler 100 generally has a conventional refrigeration system 110 positioned therein or adjacent thereto as is well known in the art. The cooler 100 also includes an insulated shell 120 with an interior refrigerated portion 125. The insulated shell 120 and the interior portion 125 may be largely of conventional design. As is shown in FIGS. 1 and 2, the cooler 100 may have a conventional rectangular shape. Alternative as is shown in FIGS. 4A–4C, the cooler 100 also may have a substantially circular shape or just the interior portion 125 may have such a circular shape. Any conventional shape, however, may be used for the cooler 100, the shell 120, or the interior portion 125.

The cooler 100 may be enclosed by an outer door 130. The outer door 130 preferably is transparent in whole or in part such that the consumer can see within the cooler 100. The outer door 130 may swing open, slide open, or open in any conventional fashion. Further, the cooler 100 may have multiple doors 130. The invention also may be applicable to coolers 100 with no door 130 at all. For example, an air door similar to that described in commonly owned U.S. Application Ser. No. 09/110,847 may be used and is incorporated herein.

Located within the cooler 100 may be a plurality of product shelves 140. The shelves 140 are preferably made from a substantially rigid, non-corrosive material such as stainless steel, aluminum, thermoplastics, or various types of composite materials. The shelves 140 are preferably, but not necessarily, angled in shape such that a lower end 141 of each shelf 140 faces the outer door 130 and a higher end 142 of each shelf 140 extends towards the rear of the cooler 100. Alternatively, the shelves 140 may be gravity feed organizers such as the shelves 140 sold under the mark "Visi-Slide" by Display Technologies of New York, N.Y. Such gravity feed organizers are generally installed within the cooler 100 at an angle, also with the lower end 141 of the shelf 140 facing the outer door 130 and the higher end 142 of the shelf 140 extending towards the rear of the cooler 100. In either case, products placed on the shelf 140 slide under the force of gravity towards the lower end 141 of the shelf 140 and the outer door 130. The shelves 140 may have an angle of about seven degrees (7°) to about nine degrees (9°) off of the horizontal. Although the shelves 140 are shown as being angled, it is understood that largely horizontal shelves 140 also may be used herein. Other alternatives may include the use of neck-tracker shelves that hold a bottle by its neck or a horizontal serpentine design. Any conventional type of shelf 140 may be used herein.

The shelves 140 of the present application are preferably circular or semi-circular in shape. Any convenient shape that permits movement of the shelf 140 within the cooler 100, however, may be used. The shelves 140 generally have a number of channels 145 positioned thereon. The products are placed within the channels 145 such that the products slide down the shelf 140 in an organized fashion. Any number of channels 145 may be used. FIGS. 1 and 2 show a first shelf 146, a second shelf 147, a third shelf 148, and a fourth shelf 149. Any number of shelves 140, however, may be used within the cooler 100. The shelves 140 may have a lattice pattern therein so as to promote airflow throughout the interior portion 125 of the cooler 100.

Each shelf 140 may be supported by a plurality of rollers 150. The rollers 150 support each shelf 140 about its periphery. The rollers 150 allow the shelves 140 to rotate within the cooler 100. The shelves 140 may be driven by a drive mechanism 152. The drive mechanism 152 may include a number of drive shafts 153 powered by a drive motor 154. The drive shafts 153 may be positioned within the interior portion 125 or the insulted shell 120 of the cooler. The drive motor 154 may be centrally located within or adjacent to the cooler 100. The drive motor 154 is preferably a conventional electrical motor. In the present embodiment, two drive shafts 153 are used, a first drive shaft 155 and a second drive shaft 156. Any number of drive shafts 153 may be used. The first drive shaft 155 is driven directly by the drive motor 154. The second drive shaft 156 is driven by the first drive shaft 155 by a set of rotation gears 157 connecting both shafts 155, 156. If the first drive shaft 155 rotates in a clockwise or counterclockwise direction, the rotation gears 157 may cause the second drive shaft 156 to rotate in the opposite direction. The drive mechanism 152 also may include other conventional types of drive means. For example, a central drive shaft 153 may be used.

Each of the shelves 140 is driven by one of the drive shafts 153 by a set of drive gears 158 connecting the shelves 140 and the shafts 153. Each shelf 140 may have a toothed surface 159 that meshes with the drive gears 158. In this embodiment, the first shelf 146 and the third shelf 148 are attached to the first drive shaft 155 for rotation in one direction while the second shelf 147 and the fourth shelf 149 are attached to the second drive shaft 156 for rotation in the opposite direction. The shafts 153 and the shelves 140 may be attached in any order or orientation. The drive gears 158 also may have a slip clutch positioned thereon. If an obstruction prevents rotation of one shelf 140, the other shelves 140 may continue to move without damage to the drive mechanism 152.

The shelves 140 may rotate at a speed of about one-eighth (⅛) to about two (2) feet per second. The shelves 140 may then stop and reverse direction. Having one shelf 140 rotating in one direction while another shelf 140 rotates in the opposite direction may magnify the appearance of speed. Any combination of directions may be used. Further, the drive mechanism 153 also may have suitable gearing for driving the shelves 140 at different or varying speeds. The rotation of the shelves 140 may be continuous or intermittent on an overall or an individual basis.

FIG. 4A shows one shelf 140 with a plurality of products 170 positioned thereon. The products 170 preferably may be bottles or cans of beverages such as carbonated soft drinks or the like. The products 170, however, may be almost any type of object that can slide down the shelf 140 within the channels 145. Any number of products 170 may be used. Likewise, various combinations of different types of products 170 may be used in any order.

To create motion within the cooler 100, each shelf 140 may oscillate by about five degrees (5°) to about thirty degrees (30°) off of a central position, a mid-point P. The extent of the oscillation depends in large part on the overall size of the cooler 100 such that almost any range of oscillation may be used. The shelf 140 may rotate a given amount in one direction, stop, return to the mid-point P, rotate the given amount in the opposite direction, stop, return to the mid-point P, and again repeat the process. For example, if each shelf 140 has seven (7) channels 145: a first channel 180, a second channel 190, a third channel 200, a fourth channel 210, a fifth channel 220, a sixth channel 230, and a seventh channel 240, the shelf 140 may rotate as is shown in FIG. 4B in a counterclockwise direction such that the products 170 within the first channel 180 are accessible by a consumer when the shelf 140 stop rotating. The shelf 140 may then rotate in a clockwise direction as is shown in FIG. 4C such that the products 170 within the seventh channel 240 are accessible. The shelf 140 would then again stop and repeat the process.

Referring again to FIGS. 1 and 2, the cooler 100 preferably has a door switch 250 positioned thereon. The door switch 250 may be in communication with the drive mechanism 152. When the outer door 130 of the cooler 100 is opened, the door switch 250 is triggered such that the drive mechanism 152 is stopped. The consumer therefore can remove a product 170 from one of the shelves 140 without the shelves 140 rotating. Such rotation may make a consumer hesitant to grasp the product 170. The door switch 250 stops the rotation of the shelves 140 so as to eliminate this hesitation. The door switch 250 is again triggered when the door 130 is closed such that the drive mechanism 152 again rotates the shelves 140.

The cooler 100 preferably also has a reload switch 260 positioned on the shell 120. The reload switch 260 also may be in communication with the drive mechanism 152. The reload switch 260 would be used when reloading the cooler 100 with the products 170. When the cooler 100 needs to be reloaded, rotation of the shelves 140 is stopped when the door 130 is opened because of the door switch 250. The reloader then hits the reload switch 260. The reload switch 260 causes the drive mechanism 152 to rotate each of the shelves 140 about one hundred eighty degrees (180°) such that the high end 142 of each shelf 140 is now facing the door 130. Preferably, each shelf 140 will rotate in the same direction so as to prevent possible contact between the shelves 140 or the products 170. The reloader can then position the products 170 within each of the channels 145. The products 170 will slide down within each of the channels 145 towards the lower end 141 of the shelf 140. After each shelf 140 is full, the reloader again hits the reload switch 260 so as to return the shelves 140 to their original positions with the lower end 141 of each shelf 140 facing the door 130. The use of this reload method therefore ensures that the products 170 are used in a first in, first out manner within each channel 145 and each shelf 140.

In use, the shelves 140 oscillate with respect to an outside point P as is shown in FIGS. 4A–4C. The point P may represent the position of a consumer in front of the cooler 100. The rotation may be uniform or one or more shelves 140 may rotate first in a clockwise direction while one or more shelves 140 may rotate first in a counterclockwise direction. The shelves 140 may reach the full extent of travel in one direction and then reverse direction in an oscillating manner. This movement serves to catch the consumer's eye. When the consumer opens the outer door 130, the door switch 250 stops the drive mechanism 152. The shelves 140 therefore stop rotating such that the consumer may grasp one or more of the products 170 off one of the shelves 140. The consumer then shuts the door 130 such that the shelves 140 again begin oscillating.

When the cooler 100 needs to be reloaded, the reloader opens the door 130 such that the door switch 250 stops the drive mechanism 152 and the rotation of the shelves 140. The reloader then hits the reload switch 260 such that all of the shelves 140 are rotated about one hundred and eighty degrees (180°) or so such that the upper end 142 of each shelf 140 faces the door 130. The reloader then places the products 170 within each channel 145 of the shelves 140. The products 170 generally slide down from the upper end 142 to the lower end 141 of each channel 145 within the shelves 140. The reloader again hits the reload switch 260 such that the shelves 140 return to their original positions with the lower end 141 of each of the shelves 140 facing the door 130. Reloading the cooler 100 in this manner ensures that the products 170 are loaded and removed from each channel 145 and each shelf 140 in a first in, first out manner.

Figure 5:
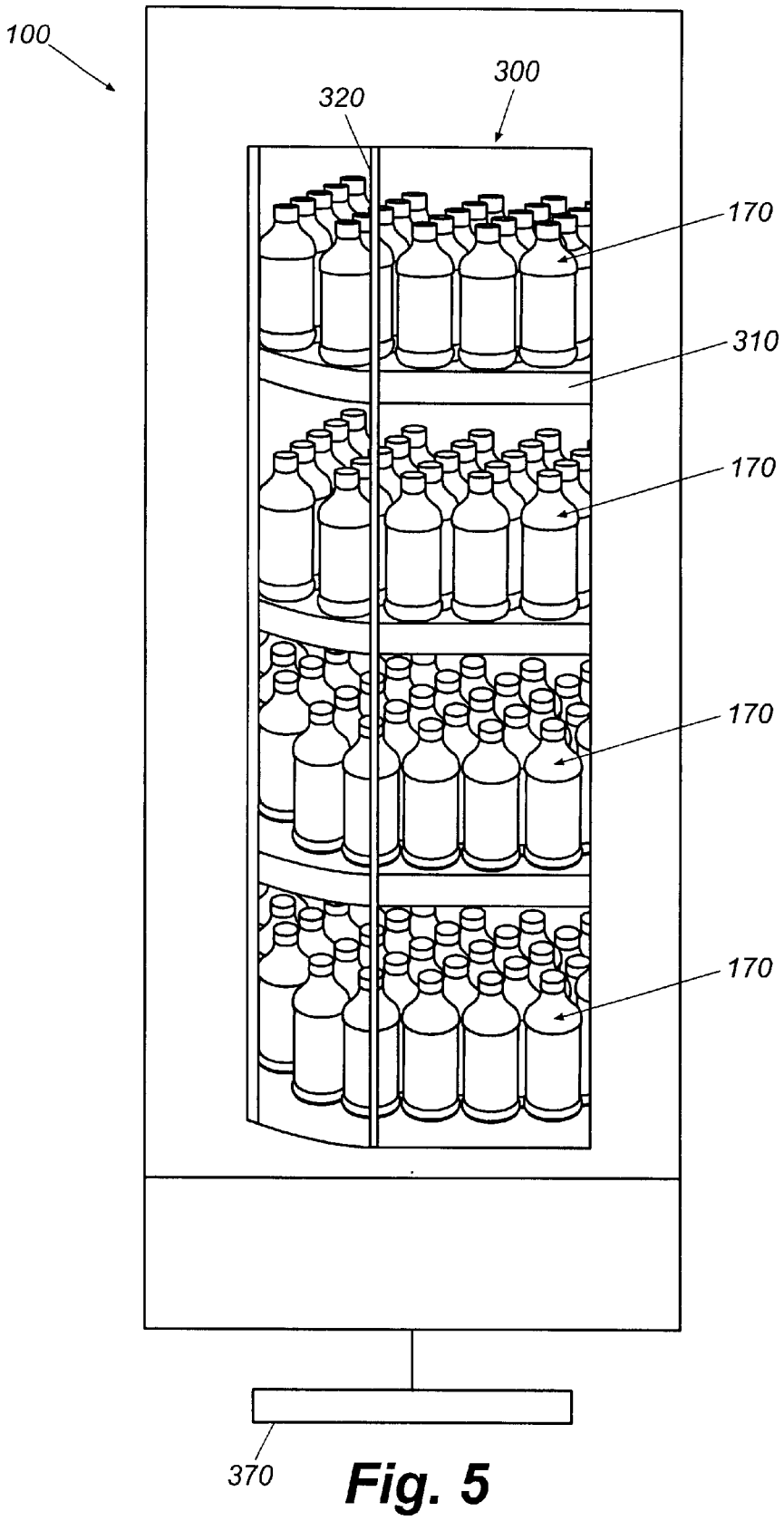
FIG. 5 is a perspective view of the cooler with an automatic door.
Figure 6:
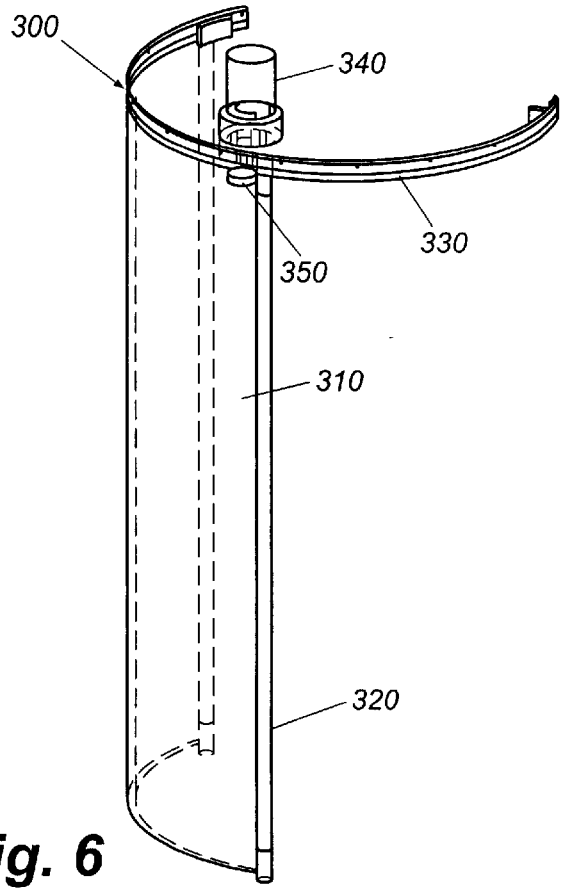
FIG. 6 is a top cross sectional view of the cooler and the automatic door.
Figure 7:
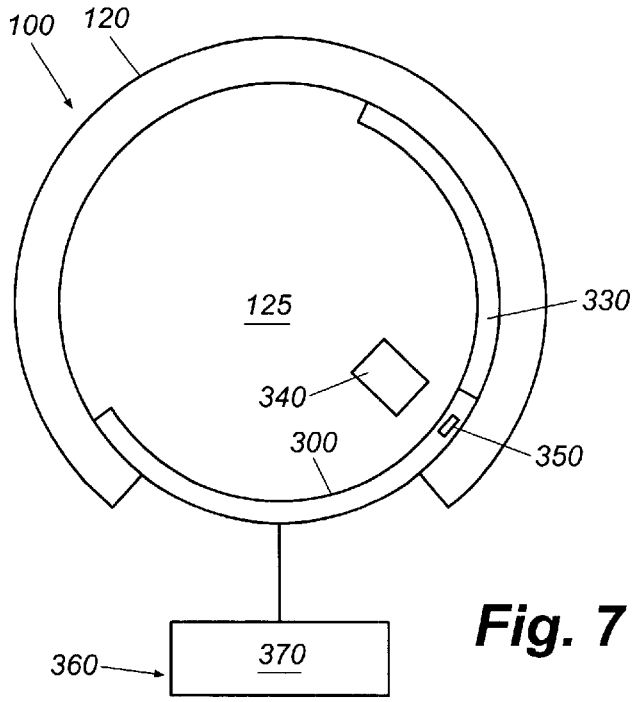
FIG. 7 is a perspective view of the door and the drive motor.

FIGS. 5–7 show a further embodiment of the present invention. This embodiment shows the use of an automatic door 300. The door 300 may be used with the circular cooler 100 shown in FIGS. 4A–4C or the door 300 may be used in any cooler 100 having a substantially or partially curved interior portion 125. The door 300 is preferably, but not necessarily mounted within the interior portion 125 of the cooler 100 and preferably follows the shape of the interior portion 125. As is shown, if the interior portion 125 is largely circular, the door 300 is also curved accordingly. The door 300 may be largely of conventional design and may include a large pane 310 surrounded by a frame 320. The door 300 may be mounted within a channel 330 or other type of guide mechanism positioned within the interior portion 125 of the cooler 100. The channel 330 may be mounted on the bottom or the top of the interior portion 125 of cooler 100, or both.

The door 300 may be driven by a drive motor 340. The drive motor 340 may be a conventional DC drive motor or any conventional type of drive device. The drive motor 340 may be mounted to the top or the bottom of the interior portion 125 of the cooler 100. The drive motor 340 may drive the door 300 via a roller 350. The roller 350 may be made from a rubber or rubberlike material. The roller 350 may drive the door 300 by direct contact with the frame 320 as is shown in FIG. 6 or by contact with the pane 310 itself as is shown in FIG. 7. The drive motor 340 rotates the roller 350 in one direction to open the door 300. The door 300 travels along the channel 330 into the interior portion 125 of the cooler 100. The drive motor 340 also rotates the roller 350 in the opposite direction to close the door 300.

The door 300 may be operated by a control system 360. The control system 360 may include one or more sensors 370 that detect the presence of the consumer adjacent to the cooler 100. The sensors 370 may be in a circuit with the drive motor 340 so as to activate the drive motor 340 to open the door 300 when a consumer is present and to close the door 300 when the consumer leaves. In this embodiment, a touch sensor 370 may be used. The touch sensor 370 may be positioned on the floor in front of the cooler 100. When a consumer walks on to the touch sensor 370, the touch sensor 370 completes or breaks the circuit so as to activate the drive motor 340 to open the door 300. The door 300 remains open as long as the consumer is on the touch sensor 370. When the consumer walks off of the touch sensor 370, the touch sensor 370 likewise completes or breaks the circuit so as to activate the drive motor 340 to close the door 300.

The sensors 370 may include any device that detects the presence of a consumer. In addition to touch or pressure sensors 370, the sensors 370 may be based upon the use of light emitters and receivers, thermal detectors, sound detectors, or any other conventional type of detection device or method. The opening and closing of the door 300 also may be delayed by a given interval so as to prevent random openings by passers-by and also to ensure that the consumer is completely out of range of the door 300 when it closes. Any conventional type of control logic may be used by the control system 360.

It should be apparent that the foregoing relates only to the preferred embodiment of the present invention and that numerous changes and modifications may be made herein without departing from the spirit and scope of the invention as defined by the following claims.

We claim:

1. A cooler, comprising:

a plurality of product shelves; and an oscillating drive mechanism connected to said plurality of product shelves such that said oscillating drive mechanism oscillates said plurality of product shelves from a first position to a second position and back to said first position.

2. The cooler of claim 1, further comprising an outer door.

3. The cooler of claim 2, wherein said outer door comprises a transparent panel such that said plurality of product shelves may be seen.

4. The cooler of claim 2, wherein said outer door comprises a door switch in communication with said oscillating drive mechanism such that said door switch turns said oscillating drive mechanism off when said outer door is opened.

5. The cooler of claim 1, further comprising an outer shell.

6. The cooler of claim 5, wherein said outer shell comprises a substantially circular shape.

7. The cooler of claim 1, wherein said plurality of product shelves comprises stainless steel, aluminum, or thermoplastics.

8. The cooler of claim 1, wherein said plurality of product shelves comprise a substantially circular shape.

9. The cooler of claim 1, wherein said plurality of product shelves comprises a speed of about one-eighth (⅛) to about two (2) feet per second.

10. The cooler of claim 1, wherein said plurality of product shelves comprises one or more shelves that oscillatingly rotate first in a first direction and one or more shelve that oscillatingly rotate first in a second direction.

11. The cooler of claim 1, wherein said plurality of product shelves may oscillate from a central point by about five degrees (5°) to about thirty degrees (30°).

12. The cooler of claim 1, wherein said plurality of product shelves comprises an angled shape.

13. The cooler of claim 12, wherein said plurality of product shelves comprise a first end and a second end and wherein said second end slopes about seven (7) degrees to about nine (9) degrees below said first end.

14. The cooler of claim 1, wherein said plurality of product shelves comprises gravity feed organizers.

15. The cooler of claim 1, wherein said plurality of product shelves comprises a plurality of product channels positioned thereon.

16. The cooler of claim 15, wherein each of said plurality of product shelves comprises a first product channel positioned on a first side of said product shelf and a second product channel positioned on a second side of said product shelf.

17. The cooler of claim 16, wherein said plurality of product shelves oscillates in a first direction such that said first product channel is accessible and then oscillates in a second direction such that said second product channel is accessible.

18. The cooler of claim 1, wherein said plurality of products shelves comprises a plurality of rollers.

19. The cooler of claim 1, wherein said oscillating drive mechanism comprises an electrical motor.

20. The cooler of claim 19, wherein said oscillating drive mechanism comprises one or more drive shafts powered by said electrical motor so as to oscillate said plurality of product shelves.

21. The cooler of claim 20, wherein said one or more drive shafts and said plurality of product shelves comprise a set of drive gears for rotation therewith.

22. The cooler of claim 19, wherein said oscillating drive mechanism comprises a first drive shaft and a second drive shaft and wherein said first drive shaft is powered by said electrical motor.

23. The cooler of claim 22, wherein said first and said second drive shafts are connected by a set of rotation gears such that said first drive shaft rotates first in a first direction and said second drive rotates first in a second direction.

24. The cooler of claim 23, wherein a first one of said plurality of product shelves is connected to said first drive shaft and a second one of said plurality of product shelves is connected to said second drive shaft.

25. The cooler of claim 1, further comprising a reload switch in communication with said oscillating drive mechanism such that said reload switch causes said oscillating drive mechanism to rotate said plurality of product shelves about one hundred and eighty degrees.

26. The cooler of claim 1, further comprising a plurality of products positioned on said plurality of product shelves.

27. The cooler of claim 26, wherein said plurality of product shelves each comprises an upper end and a lower end such that said plurality of products slide towards said lower end.

* * * * *